US010269245B2

(12) United States Patent
Jordan

(10) Patent No.: US 10,269,245 B2
(45) Date of Patent: Apr. 23, 2019

(54) SERVER, SYSTEM, AND METHOD FOR DETERMINING A POSITION OF AN END OF A TRAFFIC JAM

(71) Applicant: Bayerische Motoren Werke Aktiengesellschaft, Munich (DE)

(72) Inventor: Justus Jordan, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/666,829

(22) Filed: Aug. 2, 2017

(65) Prior Publication Data

US 2017/0330458 A1 Nov. 16, 2017

Related U.S. Application Data

(63) Continuation of application No. PCT/EP2016/051514, filed on Jan. 26, 2016.

(30) Foreign Application Priority Data

Feb. 24, 2015 (DE) ..... 10 2015 203 233

(51) Int. Cl.
*G08G 1/0967* (2006.01)
*G08G 1/01* (2006.01)

(52) U.S. Cl.
CPC ..... *G08G 1/096775* (2013.01); *G08G 1/0112* (2013.01); *G08G 1/0129* (2013.01); *G08G 1/0133* (2013.01); *G08G 1/0141* (2013.01); *G08G 1/096716* (2013.01); *G08G 1/096758* (2013.01)

(58) Field of Classification Search
CPC .. G08G 1/0112; G08G 1/0133; G08G 1/0141; G08G 1/096775
USPC ..... 340/905
See application file for complete search history.

(56) References Cited

U.S. PATENT DOCUMENTS 9,286,797 B1 * 3/2016 Blandin ..... G08G 1/0133
2006/0271269 A1 * 11/2006 Stolle ..... G05B 13/027 701/106
2007/0005231 A1 * 1/2007 Seguchi ..... G08G 1/0104 701/117
2011/0102193 A1 5/2011 Staehlin
(Continued)

FOREIGN PATENT DOCUMENTS

CN 103914985 A 7/2014
DE 10 2012 007 367 A1 11/2012
(Continued)

OTHER PUBLICATIONS

International Search Report (PCT/ISA/210) issued in PCT Application No. PCT/EP2016/051514 dated Apr. 14, 2016 with English translation (Six (6) pages).
(Continued)

*Primary Examiner* — Hirdepal Singh
(74) *Attorney, Agent, or Firm* — Crowell & Moring LLP

(57) ABSTRACT

A system and method is provided for determining a position of an end of a traffic jam using traffic measurement data received from a plurality of vehicle and at least one sigmoid function. A system server configured to execute the method includes a computer unit, a memory, a receiving unit for receiving a plurality of measured data, each having one position data indication of a vehicle.

12 Claims, 5 Drawing Sheets

(56) References Cited

U.S. PATENT DOCUMENTS

| | | | | |
|---|---|---|---|---|
| 2011/0298637 | A1* | 12/2011 | Posner | H04H 20/55 340/905 |
| 2013/0013179 | A1* | 1/2013 | Lection | G08G 1/0145 701/117 |
| 2014/0114556 | A1* | 4/2014 | Pan | G08G 1/00 701/119 |
| 2014/0257665 | A1* | 9/2014 | Kagerer | B60K 31/0008 701/96 |
| 2014/0368358 | A1* | 12/2014 | Xie | G08G 1/08 340/922 |
| 2016/0210852 | A1* | 7/2016 | Buchholz | G08G 1/0112 |
| 2016/0210853 | A1* | 7/2016 | Koravadi | G08G 1/0141 |
| 2016/0247397 | A1* | 8/2016 | Xu | G08G 1/0125 |
| 2017/0225687 | A1* | 8/2017 | Pu | B60W 40/04 |

FOREIGN PATENT DOCUMENTS

| | | | |
|---|---|---|---|
| DE | 10 2013 014 872 | A1 | 3/2015 |
| EP | 1 235 195 | A2 | 8/2002 |

OTHER PUBLICATIONS

German-language Written Opinion (PCT/ISA/237) issued in PCT Application No. PCT/EP2016/051514 dated Apr. 14, 2016 (Seven (7) pages).

German-language Search Report issued in counterpart German Application No. 10 2015 203 233.7 dated Nov. 17, 2015 with partial English translation (Twelve (12) pages).

* cited by examiner

SERVER, SYSTEM, AND METHOD FOR DETERMINING A POSITION OF AN END OF A TRAFFIC JAM

CROSS REFERENCE TO RELATED APPLICATIONS

This application is a continuation of PCT International Application No. PCT/EP2016/051514, filed Jan. 26, 2016, which claims priority under 35 U.S.C. § 119 from German Patent Application No. 10 2015 203 233.7, filed Feb. 24, 2015, the entire disclosures of which are herein expressly incorporated by reference.

BACKGROUND AND SUMMARY OF THE INVENTION

The invention relates to a server, a system and a method for determining a position of an end of a traffic jam.

A server for determining a location statement for a traffic jam is known from the prior art. Google Traffic can determine the geographical area in which a traffic jam has occurred. In this case, the server evaluates the speed of smartphones situated in vehicles, for example. These traffic jam data indicate the location of the traffic jam only with excessive inaccuracy, however. The type of the traffic jam, future development thereof or the most recent development to have dynamically taken place cannot be determined using the Google Traffic approach.

Another way of determining the location of the traffic jam is to install stationary sensors, such as cameras or induction loops, on a relevant section of road. These stationary sensors evaluate the traffic state, particularly the traffic flow and the traffic density. In this case, the speed and the distances between the individual vehicles are measured and the traffic flow and the traffic density are computed therefrom.

A disadvantage of this type of location determination is that the position of the end of the traffic jam can be computed only in the section of road in which the sensors have been installed. The installation of stationary sensors, such as cameras or induction loops, is very expensive and therefore not used extensively.

EP 1 235 195 A2 describes a method for determining traffic jam data. In this case, a first vehicle transmits its current position, which is coupled to a time statement, to a control center. The control center stores this information in a database and uses the data to determine a route of the first vehicle. Using further routes of other vehicles that are in the vicinity of the first vehicle and are likewise stored in the database, the control center produces a route forecast for the first vehicle. This route forecast provides information about how the speed of the first vehicle will change in all likelihood on the forthcoming route section. The precise location, the behavior of the traffic jam and the position of the end of the traffic jam cannot be ascertained with this approach either.

US 2007/0005231 A1 describes a system and a method for determining the position of an end of a traffic jam. A vehicle associated with the system comprises a controller that is used to analyze the speed of the vehicle. As soon as the vehicle, traveling at constant speed, approaches an end of a traffic jam and therefore reduces its speed, the controller stipulates the end of the traffic jam as being at the position at which the speed of the vehicle is approximately zero or is constantly at a very low speed level. This has the disadvantage that the position of the end of the traffic jam can be determined only very inaccurately. If there is, by way of example, a very soft end of the traffic jam at which the speed firstly decreases steadily but secondly does not assume the value zero or does not reach a very low and constant level, then this system and method cannot be used to effect exact position finding for the end of the traffic jam.

Against the background of this prior art, the object arises of providing a server, a system and a method that address the aforementioned disadvantages. In particular, the aim is to provide a server that determines the exact position of the end of the traffic jam and possibly the development thereof extensively and independently of location. In this case, the aim is for exact position finding for the end of the traffic jam to be effected even in the case of soft ends of traffic jams that the vehicles enter steadily at ever slower speed. A further object is to provide a server for determining the position of the end of the traffic jam that is capable of determining the type of the end of the traffic jam, for example, determining whether it is necessary to brake sharply on entering the end of the traffic jam (a "hard end" of the traffic jam), or whether a slow speed reduction be assumed (i.e., a soft end of the traffic jam).

The object is achieved by a server for determining a position of an end of a traffic jam that comprises

- a computer unit;
- a memory;
- a reception unit for receiving a multiplicity of measurement data, in each case with at least one position data statement for a vehicle.

In this case, the server is preferably designed to use at least one sigmoid function and to use the received measurement data in order to compute the position of the end of the traffic jam.

The at least one sigmoid function sig(x) used to locate and characterize the position of the end of the traffic jam may have the following formula, for example:

$$sig(x) = \frac{a_1}{1 + e^{a_2(a_3 - x)}} + a_4$$

This may, as depicted, be defined on the basis of four parameters [a1, a2, a3, a4].

The sigmoid functions in this case, for example in a first iteration cycle, may be determined by randomly chosen parameter values. The measurement data can be used to select at least one sigmoid function that models the real traffic jam profile and hence also the end of its traffic jam well. The selected and hence high quality sigmoid function may be used to compute the position of the end of the traffic jam.

Alternatively or additionally, parameter values of the sigmoid functions may be determined or computed on the basis of at least some of the measurement data. The measurement data are, by way of example, transmitted by a vehicle via a radio network, preferably a mobile radio network, to the server, which stores them in its memory. The measurement data may comprise a position data statement for a vehicle which may be used by the computation unit to compute the speed of the vehicle on the basis of the time of transmission of the position data statements.

An advantage of the server according to the invention is that it can use the sigmoid function to determine the position of the end of the traffic jam, regardless of the position from which the vehicle sent its measurement data to the server. The sending vehicle may still be situated before or even just a short way after the position of the end of the traffic jam.

The sigmoid function is thus suited to being able to make statements about the end of the traffic jam even using measurement data from any positions, for example within the traffic jam.

A further advantage is that the profile of the sigmoid function may be used to determine how the speed of the vehicle changes over time. This may be used to characterize the end of the traffic jam. If the sigmoid functions has a rapid and sharp fall in the profile, then a hard end of the traffic jam is involved, in which vehicles encounter, from unrestricted travel, a buildup of, by way of example, stationary vehicles. If the sigmoid function has a slow and shallow fall in the profile, then this indicates that the end of the traffic jam is entered with a slow speed reduction with surrounding vehicles, and hence there is a soft end of the traffic jam. The server may be designed to convey corresponding knowledge to subscribers, for example vehicles, that have subscribed to this service. The server can also use this knowledge to make statements about the dangerous nature of the traffic jam. By way of example, multiple danger categories (e.g. high, low, slight) may be defined, with the server dividing up the respective traffic jam into one of these categories.

Preferably, the measurement data are data tuples and comprise:

- traffic information data; and/or
- speed data that indicate at least one speed of the respective vehicle; and/or
- distance data that indicate at least one distance between the respective vehicle and a vehicle traveling ahead of the respective vehicle; and/or
- braking frequency data that indicate a braking frequency of the respective vehicle.

This allows the server to use the measurement data to determine the surroundings of the vehicle, such as the traffic density, for example. By way of example, transmission of the distance to a vehicle traveling ahead allows the server to compute the traffic density. The traffic density can in this case be computed using the following formula, for example:

$$\rho = \frac{1}{r+s}$$

In this case, the traffic density ρ is dependent on the distance r between two vehicles and the vehicle length s of the rear vehicle. The same computation may also be provided by the traffic information data, which indicate the number of vehicles in the vicinity of the vehicle or lane changing behaviors or other data relating to the traffic, for example. Similarly, it is also possible for the traffic density to be computed on the basis of the braking frequency of the vehicle. Determination of the traffic density may also be based on the entire detected surroundings of the measuring vehicle. Hence, it is also possible for the position of the end of the traffic jam to be computed by virtue of the change in the traffic density profile.

A further advantage of the invention is that the sigmoid function may be used to continuously model the traffic density over the route, preferably also over time. This allows the position of the end of the traffic jam to be determined with few measurement points, regardless of the position at which the measurement points or measurement data have been captured. It is also possible to make a statement about the type of the end of the traffic jam. If the traffic density profile rises rapidly and sharply, then a hard end of the traffic jam is involved. If the sigmoid function has a slow and shallow rise in the profile, then a soft end of the traffic jam is involved. The server may be designed to convey corresponding information to subscribers, for example vehicles that have subscribed to this service. The vehicles may process this information and use it for outputting warning signals to the driver or to other road users. Furthermore, this information may be used to influence the operation of a driver assistance system. If need be, the driver assistance system may then reduce the speed of travel.

Advantageously, the measurement data may comprise hazard warning light data. These hazard warning light data may indicate the use of the hazard warning light system of the vehicle and/or the use of a hazard warning light system of a vehicle, as detected using a sensor and/or a camera, in the vicinity of the vehicle. These hazard warning light data may contribute to performance of more accurate determination of the position and/or of the characteristics of the end of the traffic jam.

In a further embodiment of the invention, the server is designed to determine a multiplicity of parameter sets in order to compute the position of the end of the traffic jam. Each parameter set defines a first sigmoid function and a second sigmoid function. The first sigmoid function of the parameter set models a speed profile and the second sigmoid function of the parameter set models a traffic density profile. A parameter set can in this case be determined by eight parameters [v1, v2, v3, v4, ρ1, ρ2, ρ3 ρ4], wherein four parameters [v1, v2, v3, v4] map the speed profile and four parameters [ρ1, ρ2, ρ3, ρ4] map the traffic density profile. The multiplicity of parameter sets may preferably be greater than 10, more preferably greater than 100 or greater than 1000. As a parameter set defines two sigmoid functions, the first sigmoid function depicting the speed profile of the vehicle on the basis of the location and the second sigmoid function depicting the traffic density profile on the basis of the location, the advantages of the speed profile and of the traffic density profile are thus combined.

A further advantage is that lane precision location can be used to determine the characteristics of the end of the traffic jam in a manner accurate to the traffic lane. The speed profile and the traffic density profile can lead to different results for the end of the traffic jam. The server can output as the result the position that the modeled speed profile prescribes or the position that the modeled traffic density profile prescribes. It is also possible to determine a mean value between the two ascertained positions of the end of the traffic jam as the final position of the end of the traffic jam, for example the position that lies exactly between the two determined positions. The parameter sets can be used to make precise statements about characteristics of the end of the traffic jam. In this context, the type of end of the traffic jam is determined by taking into account both the change in the speed and the change in the traffic density, so that more exact statements can be made. Advantageously, the sigmoid function can also be used to model an acceleration profile or deceleration profile and analogously to determine the profile of the acceleration via the location, so as to determine the position of the end of the traffic jam. Modeling of the acceleration profile likewise allows firstly the position of the end of the traffic jam to be computed exactly and secondly the characteristic of the end of the traffic jam to be determined.

In an advantageous embodiment, the server can comprise a rating unit. The rating unit rates the quality of at least one selection from a multiplicity, computed by the server, of sigmoid functions having different parameters at least using the measurement data. The measurement data are compared with the computed sigmoid functions. The closer the profile of the sigmoid function to the value to the measurement data, the higher the quality of the sigmoid function and the better it is rated. Such rating of the sigmoid functions can be effected by virtue of the sigmoid functions being put into a class system of 10 classes, for example, with class 10 containing the highest quality of sigmoid functions. Selection of preferred sigmoid functions, for example of sigmoid functions in higher classes, such as classes 9 and 10 or the best 5, particularly the best 50 or 500, allows the determination of the position of the end of the traffic jam to be simplified and the number of correctly identified position determinations to be increased. By way of example, it is also possible for the sigmoid functions to be rated on the basis of the measurement data by determining the residual of least square fitting between the sigmoid function and the measurement data and using the magnitude of the residual to rate the respective sigmoid function.

In one embodiment, the rating unit can compute the sigmoid functions by using a particle filter and/or a support vector machine (SVM) and/or a linear discriminant analysis (LDA). The particle filter is used to produce continual updates for the sigmoid functions by new measurement data. In this context, the particle filter approximates the a posteriori distribution of the state probabilities of the sigmoid functions by a finite set of parameters [$v1$, $v2$, $v3$, $v4$, $\rho1$, $\rho2$, $\rho3$, $\rho4$]. A sample set, the particles, approximates the probability density function using the sigmoid functions. In contrast to alternative approaches, the nonparametric form of particle filters means that they approximate any distributions. Similarly, a computed speed profile and/or traffic density profile can be interpolated by an m th degree polynomial, where m=3 is an advantageous choice. The coefficients of this polynomial can be interpreted together with other characteristics of the signal, such as the gradient of the speed over time or the gradient of the traffic density over time, as a point in an n-dimensional hyperspace. An SVM or LDA previously trained using training data is now capable of making a statement about the extent to which the computed sigmoid functions correspond to the measurement data of the vehicle. The advantages in this case can be found in the rapid and reliable rating and also the compact representation of the rating rules.

In a further form of the invention, the server can receive traffic jam data from a further server. The traffic jam data indicate an area at which a traffic jam has occurred. The traffic jam data are used to compute the sigmoid function. Such computation can be effected by virtue of the server computing the sigmoid function by making a parameter preselection, the parameter preselection being effected on the basis of the traffic jam data. This allows the computation of the sigmoid functions to be controlled in a suitable manner in advance. The traffic jam data actually allow a parameter preselection to be made that models only such sigmoid function profiles as have a higher quality at the outset than sigmoid functions that have been computed by a random selection of the parameters. This has the advantage that the computation of the sigmoid functions is optimized and the position of an end of the traffic jam is determined in an improved and more rapid manner.

Furthermore, the object is achieved by a system that comprises a server, as has been described in the preceding explanations, and vehicles, wherein the vehicles are designed to transmit measurement data to the server. Similar or identical advantages to those already described in connection with the server are obtained.

In a preferred embodiment, at least one vehicle may be designed to transmit measurement data at regular intervals of time. In a further preferred system, at least one vehicle can transmit measurement data when a corresponding request is received from the server. Similarly, a combination of regular measurement data transmission and measurement data transmission on request is possible. It is also possible for triggering to allow the at least one vehicle itself to transmit measurement data to the server. In this case, the triggering can have a function of various database management systems, in particular large relational database management systems, and a particular type of changes in data can prompt a stored program to be called that allows or prevents this change and/or performs further activities, such as transmitting selected measurement data to the server, for example. This ensures optimum and suitable measurement data transmission within the system.

In a further advantageous embodiment, the server may be designed to select at least one vehicle from a list of vehicles, particularly using traffic jam data, and to ask the selected vehicle to transmit measurement data. In this case, the server can ask all vehicles that are on the list to regularly transmit to it at least position data that are additionally assigned to the vehicles on the list. On the basis of these position statements, the server selects vehicles that are in a vicinity of the traffic jam known from the traffic jam data and asks said vehicles to send measurement data to it. A further option is for the server to start the measurement data request from vehicles only as soon it has information available about a traffic jam. In this case, the server can firstly request all measurement data for the vehicles that are shown on the list. Secondly, in a first step, the server can start a position request for all listed vehicles and store only the position of the vehicles on the list. Based on the traffic jam data, the vehicles would then be selected, with vehicles that are situated in the area of the traffic jam being able to be selected. If there are still no measurement data available from these vehicles, then in a second step the server can request said measurement data in order to compute the position of the end of the traffic jam. All options have the advantage of simplifying, optimizing and suitably ensuring the measurement data transmission between the vehicles and the server.

In a further preferred embodiment, the server may be designed:

a) to take the traffic jam data as a basis for determining not only a traffic direction but also a provisional position of the end of the traffic jam and/or of a traffic jam center and/or of a traffic jam start;

b) to determine a vehicle position and a vehicle direction of travel for a multiplicity of vehicles;

c) to use the vehicle position and the vehicle direction of travel to select at least one vehicle that is before the provisional position of the end of the traffic jam and/or of the traffic jam center, preferably before the provisional position of the traffic jam start, and is moving toward the end of the traffic jam.

As a result of the selection of vehicles that are situated at a position before the position of the end of the traffic jam and are traveling toward the latter, only such measurement data from vehicles as are also directly related to the position to be computed for the end of the traffic jam are used. Hence, the measurement data transmission is optimized and reduced still further.

In a further embodiment, the at least one vehicle can comprise at least one distance measuring unit. This distance measuring unit may be designed to measure the distance between the vehicle and a vehicle traveling ahead of the vehicle. The distance can be used to ascertain and/or transmit traffic information data. Such a distance measuring unit may be, by way of example, the front radar for the ACC (Adaptive Cruise Control), a laser, a camera or another unit that is suitable for measuring the distance from a vehicle traveling ahead. An advantage of such a distance measuring unit is that the distance values can model a traffic density profile. On the basis of the speed and the distance from the vehicle traveling ahead, the computer unit or the vehicle itself can determine the traffic density arising in the surroundings of the measuring vehicle.

In a preferred embodiment, the server may be designed to transmit the computed position of the end of the traffic jam to vehicles. This allows presentation of the position of the end of the traffic jam in the vehicle. This informs the driver about the exact position and/or also about the characteristic of the end of the traffic jam, for example by means of his navigation appliance. If the end of the traffic jam is situated after a blind curve, for example, or if a hard end of the traffic jam is involved, then the driver of the vehicle can be forewarned in good time, so that the risk of accident can be reduced.

Further, the object is achieved by a method for determining a position of a end of the traffic jam, particularly by a server as has been described in the preceding embodiments, and/or within a system as has been described in the preceding embodiments, comprising the steps of:

- determining a multiplicity of parameter sets, wherein each parameter set defines a first sigmoid function and a second sigmoid function, wherein the first sigmoid function of the parameter set models a speed profile and the second sigmoid function of the parameter set models a traffic density profile;
- receiving measurement data for at least one vehicle;
- rating the quality of at least some of the sigmoid functions defined by the parameter sets based on the received measurement data;
- selecting at least one parameter set based on the rating;
- computing the position of the end of the traffic jam on the basis of the at least one selected parameter set;
- sending the position of the end of the traffic jam to a/the vehicle.

Similar or identical advantages are obtained to those already described in conjunction with the server and the system.

A further preferred method comprises the steps of:

- generating, preferably randomly generating, further parameter sets on the basis of the at least one selected parameter set, particularly within prescribed ranges of variation;
- receiving further measurement data for at least the vehicle or for a further vehicle;
- rating the quality of at least some of the sigmoid functions defined by the further parameter sets based on the received second measurement data;
- selecting at least one further parameter set based on the rating;
- computing the position of the end of the traffic jam on the basis of the at least further selected parameter set;
- sending the position of the end of the traffic jam to a/the vehicle or a/the further vehicle.

New parameter sets can be generated by virtue of the eight parameters per parameter set each being slightly altered at random with a certain level of noise. This measure allows a multiplicity of different parameter sets to be produced again. As a result of the previously selected parameter set, the new parameter sets represent the traffic state in an improved and adapted form in comparison with the first parameter sets. As a result of fresh rating and selection of the parameter sets, it is possible for the position of the end of the traffic jam that was computed in a first step to be determined in an even more concrete form and more exactly by this second step. The generation of new parameter sets, the collation and rating of these new parameter sets with always new measurement data can be repeated as often as desired. Therefore, not only is it possible for the position and also the characteristic of the end of the traffic jam to be determined ever more exactly, the current changing circumstances are at the same time also repeatedly adapted.

The object according to the invention is furthermore achieved by a computer-readable storage medium that has executable instructions that prompt a computer to implement the method already described when said instructions are executed. Similar or identical advantages to those already described in conjunction with the server, the system and the method are obtained.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
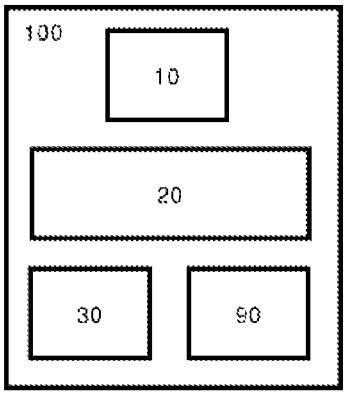
FIG. 1 shows a schematic depiction of a server in accordance with an embodiment of the present invention.

In the description below, the same reference numerals are used for parts that are the same and have the same action.

The aim of the server 100 is to compute the position of an end of a traffic jam.

In the text below, an end of a traffic jam is intended to be understood to mean the position at which a vehicle is prompted on the basis of external influences, such as by a traffic accident, increased volume of traffic or environmental influences, for example, to reduce either the vehicle's speed and/or the distance from a vehicle traveling ahead.

FIG. 1 shows a schematic depiction of a server 100 that comprises a computer unit 10, a memory 20, a reception unit 30 and a rating unit 90.

Figure 2:
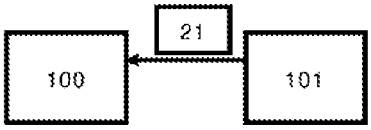
FIG. 2 shows a schematic depiction of two intercommunicating servers in accordance with an embodiment of the present invention.

As depicted in FIG. 2, the server 100 receives traffic jam data 21 from a further server 101. The traffic jam data 21 indicate an area on a road at which a traffic jam has occurred.

Figure 3:
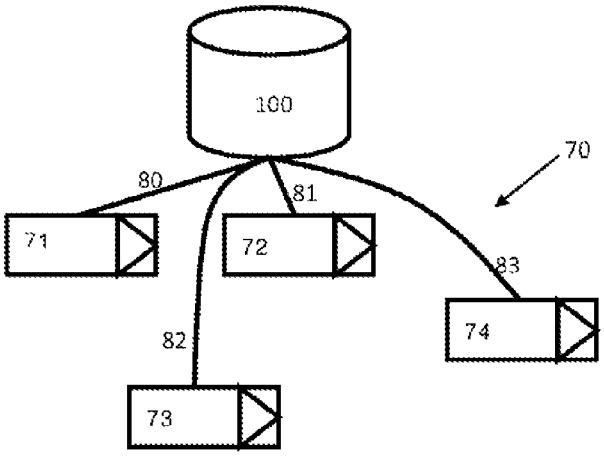
FIG. 3 shows a schematic depiction of a system in accordance with an embodiment of the present invention.

The reception unit 30 is designed to receive a multiplicity of measurement data 80, 81, 82, 83, as depicted in FIG. 3. The measurement data 80, 81, 82, 83 each comprises at least one position data statement x from vehicles 71, 72, 73, 74, wherein the vehicles 71, 72, 73, 74 are a vehicle fleet 70. The vehicle fleet 70 is defined by virtue of its being vehicles 71, 72, 73, 74 that are in direct proximity to one another and are all traveling in the same direction.

The server 100 is designed to use at least one sigmoid function, which is defined by four parameters [a1, a2, a3, a4], for example, and to use the received measurement data 80, 81, 82, 83 to compute the position x2 of the end of the traffic jam. In this case, for example in a first iteration cycle, the sigmoid functions are determined by randomly chosen parameter values. It is also possible for the parameters [a1, a2, a3, a4] of the sigmoid function to be computed using the traffic jam data 21.

FIG. 3 likewise shows a schematic depiction of a system. The system comprises the server 100 and the vehicles 71, 72, 73, 74, wherein the vehicles 71, 72, 73, 74 are designed to transmit measurement data 80, 81, 82, 83 to the server 100. In this case, the measurement data 80, 81, 82, 83 can be automatically transmitted from the vehicles 71, 72, 73, 74 to the server 100 at regular intervals of time, or the measurement data 80, 81, 82, 83 are transmitted only at the request of the server 100. A combination of the two types of transmission is also conceivable. This ensures optimum and suitable measurement data transmission within the system.

Further, the server 100 selects at least one vehicle 71 from a list of vehicles 71, 72, 73, 74, particularly using traffic jam data 21. The selected vehicle 71 is asked to transmit measurement data 80 to the server 100. The vehicle 71 can be selected in different ways:

In a first option, the server 100 asks all vehicles 71, 72, 73, 74 that are on the list to regularly transmit to it at least position data x that are additionally assigned to the vehicles 71, 72, 73, 74 on the list. On the basis of these position statements x, the server 100 selects vehicles 71, 72, 73, 74 that are situated in the vicinity of the traffic jam known from the traffic jam data 21 and asks said vehicles to send measurement data 80, 81, 82, 83 to it, which the server 100 uses to determine the position of the end of the traffic jam x2.

A further option involves the server 100 starting the measurement data request from vehicles 71, 72, 73, 74 only as soon as it has information 21 available about a traffic jam. In this case, the server 100 can firstly request all measurement data 80, 81, 82, 83 for the vehicles 71, 72, 73, 74 that are shown on the list. Secondly, in a first step, the server 100 can start a position request for all listed vehicles 71, 72, 73, 74 and store only the position x of the vehicles 71, 72, 73, 74 on the list. Based on the traffic jam data 21, the vehicles 71, 72, 73, 74 are then selected, with vehicles 71, 72, 73, 74 that are situated in the area of the traffic jam being selected. If there are still no measurement data 80, 81, 82, 83 available from these vehicles 71, 72, 73, 74, then in a second step the server 100 can request said measurement data in order to compute the position of the end of the traffic jam x2.

The server 100 is also designed to take the traffic jam data 21 as a basis for determining the provisional position of the end of the traffic jam x2 and/or of a traffic jam center and/or of a traffic jam start, and also the traffic direction in which the traffic jam has occurred. The same determination of the server 100 is also effected for a multiplicity of vehicles 71, 72, 73, 74, wherein the vehicle position x and vehicle direction of travel thereof are determined. Using the vehicle position x and the vehicle direction of travel, the server 100 selects at least one vehicle 71 that is situated before the provisional position of the end of the traffic jam x2 and/or of the traffic jam center, preferably before the provisional position of the traffic jam start, and is moved toward the end of the traffic jam x2. As a result of the selection of vehicles 71, 72, 73, 74 that are situated at a position x1 before the position of the end of the traffic jam x2 and are traveling toward the latter, only such measurement data 80, 81, 82, 83 from vehicles 71, 72, 73, 74 as are also directly related to the position to be computed for the end of the traffic jam are used. Hence, the measurement data transmission is optimized and reduced still further.

As soon as the server 100 has computed the position of the end of the traffic jam x2, it transmits this position x2 to the vehicles 71, 72, 73, 74. This allows presentation of the position of the end of the traffic jam x2 in the vehicles 71, 72, 73, 74. This informs the driver about the exact position x2 and/or also about the characteristic of the end of the traffic jam, for example by means of his navigation appliance. If the end of the traffic jam x2 is situated after a blind curve, for example, or if a hard end of the traffic jam is involved, then the driver of the vehicle 71, 72, 73, 74 can be forewarned in good time, so that the risk of accident is reduced.

Figure 4:
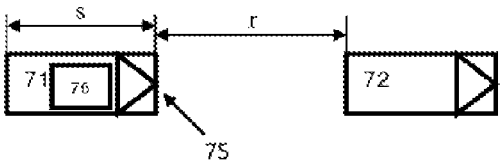
FIG. 4 shows a schematic plan view of two vehicles traveling in succession.

The measurement data 80, 81, 82, 83 transmitted by the vehicles 71, 72, 73, 74 are data tuples. These data tuples comprise traffic information data, speed data, which indicate a speed v of the respective vehicle 71, and distance data, which indicate a distance r between the respective vehicle 71 and a vehicle traveling ahead of the respective vehicle 71. As depicted in FIG. 4, the vehicle 71 comprises a transmission unit 76 in order to transmit the measurement data 80 to the server 100. Further, the vehicle 71 comprises a distance measuring unit 75 in order to measure the distance r from a vehicle 72 traveling ahead.

Using the measurement data 80, 81, 82, 83, the server 100 determines the surroundings of the vehicle 71, such as the traffic density p, for example, wherein the traffic density ρ is dependent on the measured distance r and the vehicle length s of the measuring vehicle 71.

Figure 5:
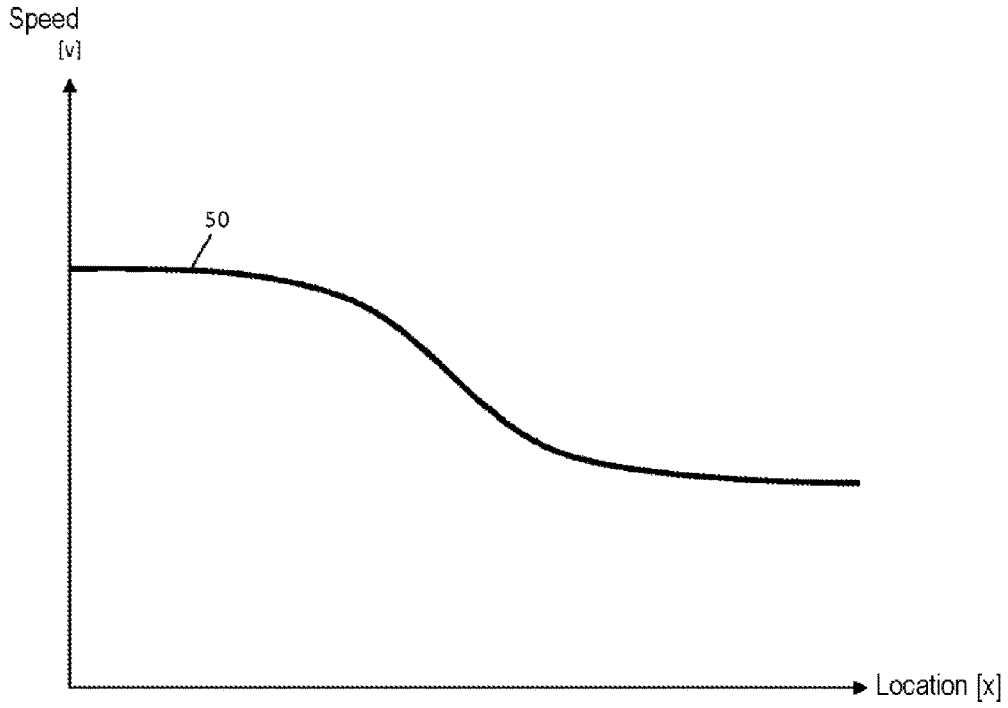
FIG. 5 shows a sigmoid function that models a speed profile in accordance with an embodiment of the present invention.
Figure 6:
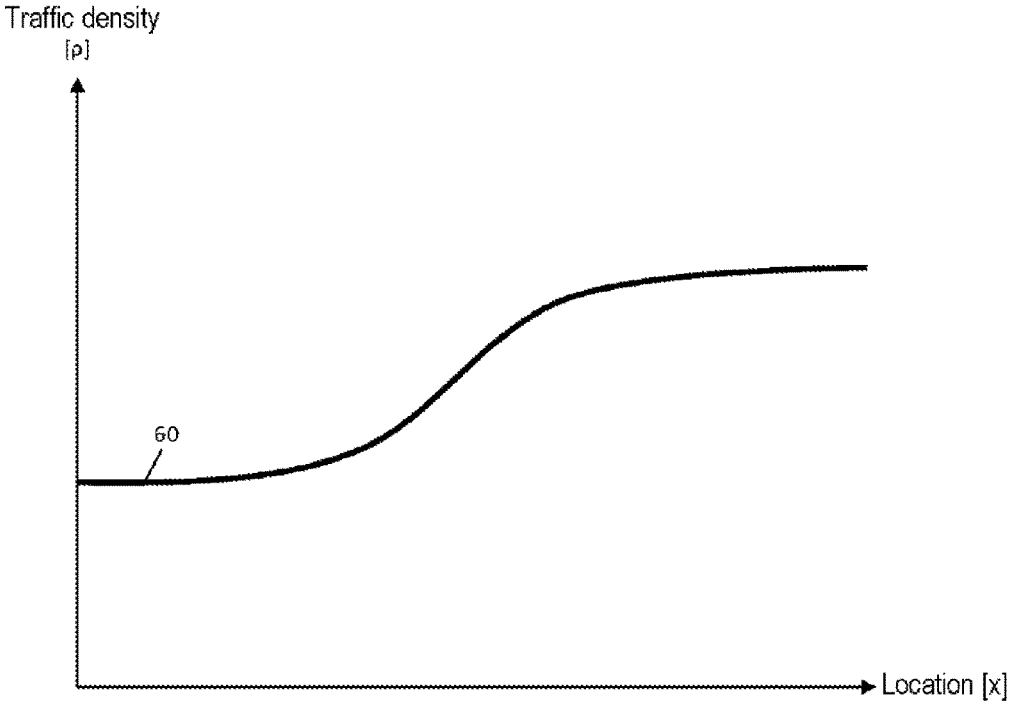
FIG. 6 shows a sigmoid function that models a traffic density profile in accordance with an embodiment of the present invention.

FIG. 5 shows a sigmoid function that models a speed profile 50 and is defined by four parameters [v1, v2, v3, v4]. This depicts how the speed v of a vehicle 71 changes over the location x. FIG. 6 shows a sigmoid function that models a traffic density profile 60 and is defined by four parameters [ρ1, ρ2, ρ3, ρ4]. This depicts how the traffic density ρ in the vicinity of a vehicle 71 changes over the location x. A speed profile 50 and a traffic density profile 60 respectively depict a parameter set 40. The server 100 is designed to determine a multiplicity of parameter sets 40, 42 in order to compute the position of the end of the traffic jam x2. A parameter set 40, 42 can in this case be determined by eight parameters [v1, v2, v3, v4, ρ1, ρ2, ρ3, ρ4]. Lane precise location of the vehicles 71, 72, 73, 74 therefore determines the position of the end of the traffic jam x2 and the characteristics of the end of the traffic jam in a manner accurate to traffic lane.

Figure 7:
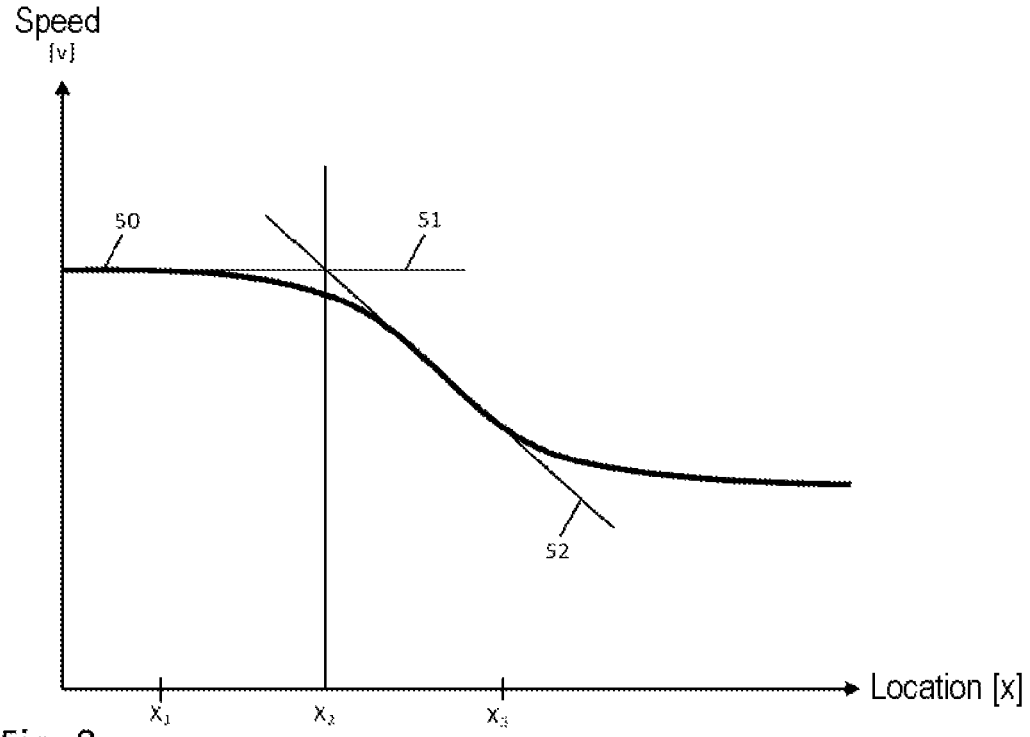
FIG. 7 shows a sigmoid function from FIG. 5 for determining the position of the end of the traffic jam.
Figure 8:
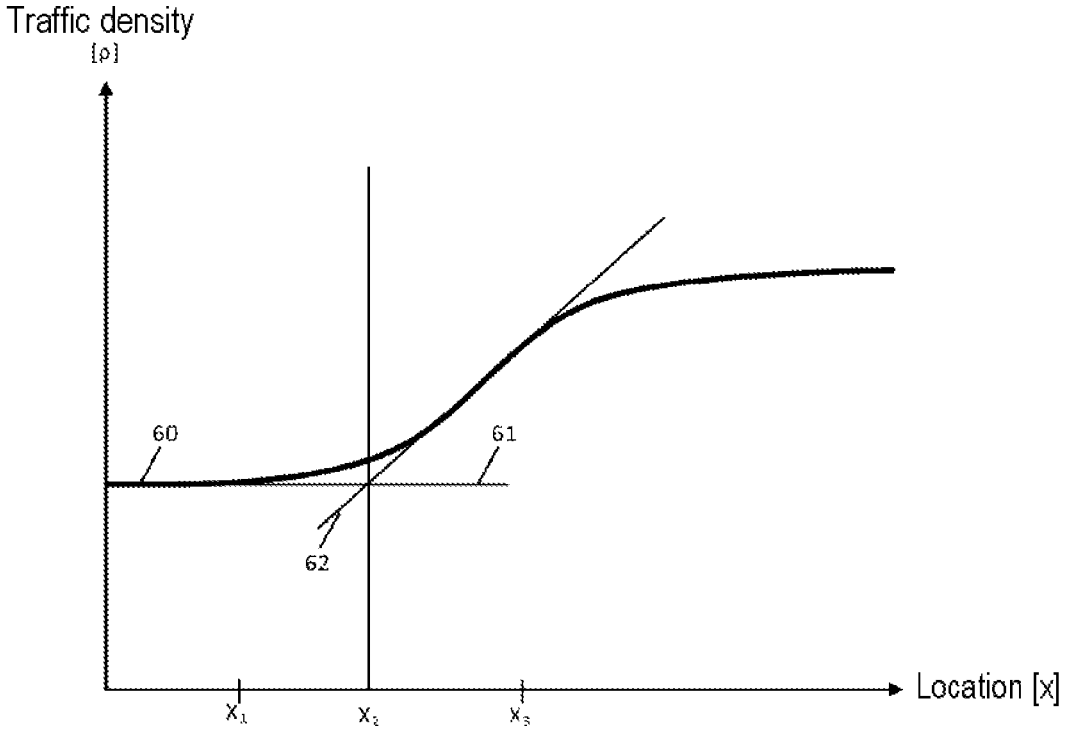
FIG. 8 shows a sigmoid function from FIG. 6 for determining the position x2 of the end of the traffic jam.

FIG. 7 uses the speed profile 50 and FIG. 8 uses the traffic density profile 60 to show how the position of the end of the traffic jam x2 is determined. In this case, in the speed profile 50, a tangent 51 is drawn to the constant speed v at a position x1 before the end of the traffic jam x2. A second straight line at a position x3 within the traffic jam depicts the slope 52 of the speed decrease after the end of the traffic jam x2. The intersection of the tangent 51 and the slope 52 determines the position of the end of the traffic jam x2 and hence the start of the traffic jam entry. The same method is applied in FIG. 8 using the traffic density profile 60 so as likewise to determine the position of the end of the traffic jam x2. In this case, a tangent 61 is drawn to the constant traffic density ρ at a position x1 before the end of the traffic jam x2. A second straight line at a position x3 within the traffic jam depicts the slope 62 of the traffic density increase after the end of the traffic jam x2. The intersection of the tangent 61 and the slope 62 determines the position of the end of the traffic jam x2 and hence the start of the traffic jam entry.

If the slope 52 of the speed profile 50 decreases rapidly and the slope 62 of the traffic density profile 60 increases rapidly, then a hard end of the traffic jam is involved, in which vehicles 71, 72, 73, 74 encounter, from unrestricted traffic, a buildup of, by way of example, stationary vehicles. If the slope 52 of the speed profile 50 decreases slowly and the slope 62 of the traffic density profile 60 increases slowly, then a soft end of the traffic jam is involved, which the vehicles 71, 72, 73, 74 steadily enter at an ever slower speed v.

Figure 9:
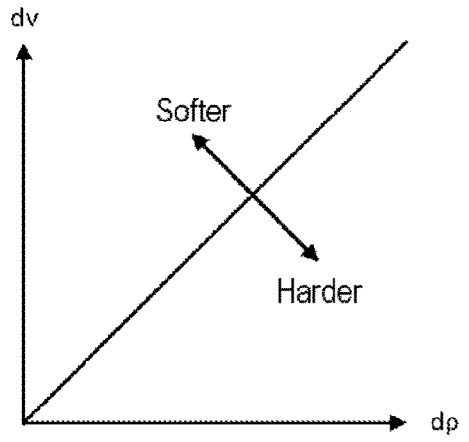
FIG. 9 shows a schematic depiction for determining the characteristic of an end of the traffic jam in accordance with an embodiment of the present invention.

A further option for determining the characteristic of the end of the traffic jam is depicted in FIG. 9. If the gradient dv of the speed decrease over time has a high negative value and the gradient dρ of the traffic density increase over time has a high positive value, then a hard end of the traffic jam is involved in this case. Conversely, if the speed gradient over time has a low negative value and the traffic density gradient over time has a low positive value, then a soft end of the traffic jam is involved.

As a result of the transmission of the position of the end of the traffic jam x2 and the transmission of the characteristic of the end of the traffic jam by the server 100 to the vehicles 71, 72, 73, 74, this information is processed and used to output warning signals to the driver himself or to other road users.

Figure 10:
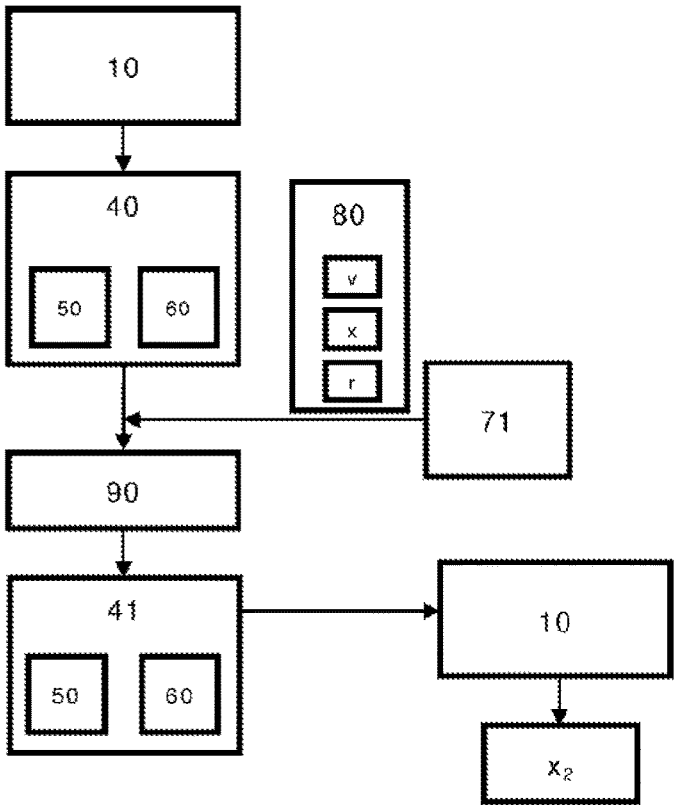
FIG. 10 shows a schematic flowchart for determining the position of the end of the traffic jam in accordance with an embodiment of the present invention.

FIG. 10 shows a flowchart for a method that is used to determine the position of the end of the traffic jam x2. In this case, the server 100 is designed to perform the following steps:

- determining a multiplicity of parameter sets 40, wherein each parameter set 40 defines a first sigmoid function and a second sigmoid function, wherein the first sigmoid function models a speed profile 50 and the second sigmoid function models a traffic density profile 60;
- receiving measurement data 80 for at least one vehicle 71;
- rating the quality of at least some of the sigmoid functions defined by the parameter sets 40 using a rating unit 90 based on the received measurement data 80;
- selecting at least one parameter set 41 based on the rating;
- computing the position x2 of the end of the traffic jam on the basis of the at least one selected parameter set 41;
- sending the position x2 of the end of the traffic jam to a/the vehicle 71.

The rating unit 90 is designed to rate the parameter sets 40 using a particle filter. The particle filter is used to produce continual updates for the sigmoid functions 50, 60 by new measurement data 80, 81, 82, 83. In this context, the particle filter approximates the a posteriori distribution of the state probabilities of the sigmoid functions 50, 60 by a finite set of parameters [v1, v2, v3, v4, ρ1, ρ2, ρ3, ρ4]. A sample set, the particles, approximates the probability density function using the sigmoid functions 50, 60. In contrast to alternative approaches, the nonparametric form of particle filters means that they can approximate any distributions.

Figure 11:
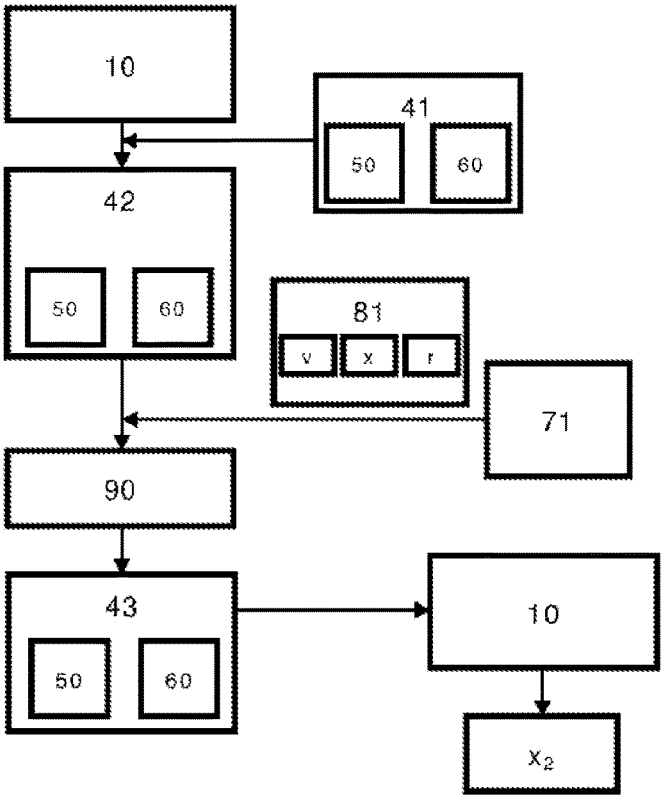
FIG. 11 shows a further schematic flowchart from FIG. 10 for determining the position of the end of the traffic jam.

For an even more accurate determination of the position of the end of the traffic jam x2 or for an update for the position of the end of the traffic jam x2, FIG. 11 shows a further flowchart that is used to determine the position of the end of the traffic jam x2. In this case, the server 100 is designed to perform the following steps:

- generating, preferably randomly generating, further parameter sets 42 on the basis of the at least one selected parameter set 41, particularly within prescribed ranges of variation;
- receiving further measurement data for at least the vehicle 71 and/or for a further vehicle 72;
- rating the quality of at least some of the sigmoid functions defined by the further parameter sets 40 using a rating unit 90 based on the further measurement data 81;
- selecting at least further parameter set 43 based on the rating;
- computing the position x2 of the end of the traffic jam on the basis of the at least further selected parameter set 43;
- sending the position x2 of the end of the traffic jam to a/the vehicle 71 or a/the further vehicle 72.

New parameter sets 42 can be generated by virtue of the eight parameters [v1, v2, v3, v4, ρ1, ρ2, ρ3, ρ4] per parameter set 41 each being slightly altered at random with a certain level of noise. This measure allows a multiplicity of different parameter sets 42 to be produced again. As a result of the previously selected parameter set 41, the new parameter sets 42 represent the traffic state in an improved and adapted form in comparison with the first parameter sets 40. As a result of fresh rating and selection of the parameter sets 42, it is possible for the position of the end of the traffic jam x2 that was computed in a first step to be determined in an even more concrete form and more exactly by this second step. The generation of new parameter sets 42, the collation and rating of these new parameter sets 42 with always new measurement data 81 can be repeated as often as desired. Therefore, not only is it possible for the position x2 and also the characteristic of the end of the traffic jam to be determined ever more exactly, the current changing circumstances are at the same time also repeatedly adapted.

Figure 12:
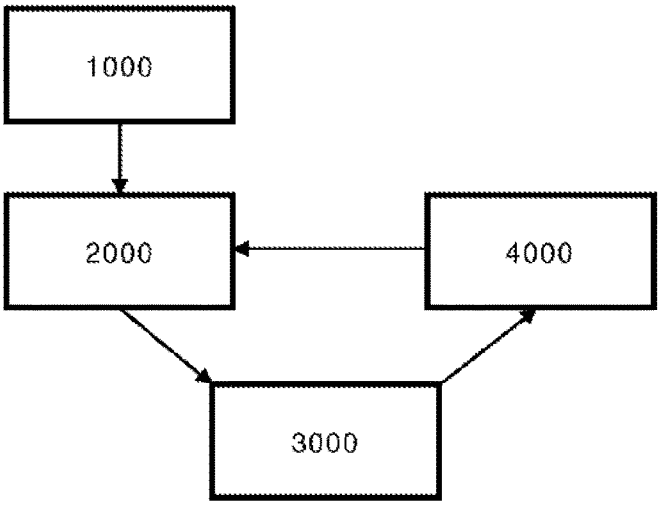
FIG. 12 shows an execution cycle for probabilistic rating of parameter sets on the basis of measurement data for several vehicles in accordance with an embodiment of the present invention.

FIG. 12 once again depicts, in another way, how the position of the end of the traffic jam x2 can be determined. The most probable parameter set 41 is estimated cyclically. At the start, randomly or with the aid of traffic jam data 21, more probable parameterizations are used—to produce a large multiplicity of parameter sets 40 having eight parameters each [v1, v2, v3, v4, ρ1, ρ2, ρ3, ρ4]. In a next step, the sigmoid functions of the speed profile 50 and of the traffic density profile 60 that are explicitly defined by eight parameters each [v1, v2, v3, v4, ρ1, ρ2, ρ3, ρ4] are rated with the aid of the measurement 1000 in the rating step 2000. Parameter sets 40 that better correspond to the measurement 1000 or are closer to the really measured case are accordingly provided with a higher rating. In the selection step 3000, the parameter sets 41 are determined that are intended to be pursued further. Subsequently, the eight parameters [v1, v2, v3, v4, ρ1, ρ2, ρ3, ρ4] per drawn parameter set 41 are each slightly altered at random with a certain level of noise. A multiplicity of different parameter sets 42 are now available again. The measurements 1000 mean that the multiplicity of parameters sets 40 now represent the traffic state better, as before the rating step 2000. If further measurement data 81 or multiple synchronous/asynchronous measurements 1000 come at a new time, then the parameter sets 41 from the last time step are predicted for the respective new time. This can be accomplished by macroscopic traffic models, for example, that are described by partial differential equations. It is also possible for the step of prediction 4000 to be completely omitted if the noise to which the parameter sets 42 are subject, which can be applied before or even after the prediction 4000, is sufficiently great to capture the dynamics of the position of the end of the traffic jam x2. This sequence of the steps rating 2000, on the basis of the measurement 1000, selection 3000 and prediction 4000 takes place cyclically and as often as desired in this case.

REFERENCE SYMBOLS

10 Computer unit
20 Memory
21 Traffic jam data
30 Reception unit
40 Parameter sets
41 Parameter set
42 Further parameter sets
43 Further parameter set
50 Speed profile
51 Tangent to the speed before the end of the traffic jam
52 Slope of the speed decrease
60 Traffic density profile
61 Tangent to the traffic density before the end of the traffic jam
62 Slope of the traffic density increase
70 Vehicle fleet
71 Vehicle
72 Further vehicle
73 Vehicle
74 Vehicle
75 Distance measuring unit
76 Transmission unit
80 Measurement data
81 Further measurement data
82 Measurement data
83 Measurement data
90 Rating unit
100 Server
101 Further server
1000 Measurement
2000 Rating
3000 Selection
4000 Prediction
x Position data statement
x1 Position before the end of the traffic jam
x2 Position of the end of the traffic jam
x3 Position after the end of the traffic jam
v Speed
dv Gradient of the speed decrease over time
ρ Traffic density
dρ Gradient of the traffic density increase over time
r Offset between two vehicles
s Length of the vehicle The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A server for determining a position of an end of a traffic jam, comprising:
a computer unit;
a memory;
a reception unit configured to receive a plurality of measurement data from a plurality of vehicles, in each case with at least one position data statement of a respective vehicle; and
a transmission unit configured to transmit the position of the end of the traffic jam to the plurality of vehicles,
wherein
the memory is configured to store at least a portion of the measurement data received by the reception unit,
the computer unit is configured to
determine the position of the end of the traffic jam using at least one sigmoid function and the portion of the measurement data stored in the memory, and
control the transmission unit to transmit the determined position of the end of the traffic jam to at least one of the plurality of vehicles,
the measurement data are data tuples which include at least one of traffic information data, speed data that includes at least one speed of the respective vehicle, distance data that includes at least one distance between the respective vehicle and a vehicle traveling ahead of the respective vehicle, and braking frequency data that includes a braking frequency of the respective vehicle,
determine a plurality of parameter sets,
each parameter set of the plurality of parameter sets defines a first sigmoid function and a second sigmoid function of the at least one sigmoid function, and
each first sigmoid function models a speed profile and each second sigmoid function models a traffic density profile.

2. The server as claimed in claim 1, further comprising:
a rating unit configured to rate a quality of the sigmoid functions of at least one of the plurality of parameter sets determined by the computer unit using at least some of the plurality of measurement data.

3. The server as claimed in claim 2, wherein
the rating unit is configured to rate sigmoid function quality using at least one of a particle filter, a support vector machine, and a linear discriminant analysis.

4. The server as claimed in claim 1, wherein
the reception unit is configured to receive from a further server traffic jam data indicative of a traffic jam area, and
the second sigmoid functions are computed using the traffic jam data.

5. A traffic jam end position determination system, comprising:
a plurality of vehicles; and
a server, the server including:
a computer unit;
a memory;
a reception unit configured to receive a plurality of measurement data from the plurality of vehicles, in each case with at least one position data statement of a respective vehicle; and
a transmission unit configured to transmit the position of the end of the traffic jam to the plurality of vehicles, wherein the memory is configured to store at least a portion of the measurement data received by the reception unit, and the computer unit is configured to determine the position of the end of the traffic jam using at least one sigmoid function and the portion of the measurement data stored in the memory, and control the transmission unit to transmit the determined position of the end of the traffic jam to at least one of the plurality of vehicles, wherein the vehicles transmit the measurement data to the server, the measurement data being data tuples which include at least one of traffic information data, speed data that includes at least one speed of the at least one vehicle of the plurality of vehicles, distance data that includes at least one distance between the at least one of the plurality of vehicles and another vehicle of the plurality of vehicles traveling ahead of the at least one of the plurality of vehicles, and braking frequency data that includes a braking frequency of the at least one of the plurality of vehicles, determine a plurality of parameter sets, wherein each parameter set of the plurality of parameter sets defines a first sigmoid function and a second sigmoid function of the at least one sigmoid function, and each first sigmoid function models a speed profile and each second sigmoid function models a traffic density profile.

6. The system as claimed in claim 5,

Wherein the at least one vehicle of the plurality of vehicles is configured to at least one of transmit the measurement data to the reception unit at regular intervals of time, and transmit the measurement data to the reception unit in response to a measurement data request from the server.

7. The system as claimed in claim 6, wherein the server is configured designed to select the at least one vehicle to receive the measurement data request based on traffic jam data.

8. The system as claimed in claim 7, wherein the server is configured to determine based on the traffic jam data a traffic direction and at least one of a provisional position of the end of the traffic jam, a center of the traffic jam, and a start of the traffic jam, determine a vehicle position and a vehicle direction of travel for each of at least a portion of the plurality of vehicles, and identify, based on the respective vehicle position and vehicle direction of travel, at least one vehicle that is at least one of before the provisional position of the end of the traffic jam and the center of the traffic jam and is moving toward the end of the traffic jam.

9. The system as claimed in claim 8, wherein the at least one vehicle includes at least one distance measuring unit configured to measure a distance between the at least one vehicle and a vehicle traveling ahead of the at least one vehicle, and the traffic information data is based on the distance between the at least one vehicle and a vehicle traveling ahead of the at least one vehicle.

10. A method for determining a position of an end of a traffic jam using traffic measurement data from a plurality of vehicles and a traffic jam end position determination system server, the server including a reception unit configured to receive the measurement data from the plurality of vehicles, in each case with at least one position data statement of a respective vehicle, a memory configured to store at least a portion of the measurement data received by the reception unit, a transmission unit configured to transmit the position of the end of the traffic jam to the plurality of vehicles, and a computer unit configured to determine the position of the end of the traffic jam using at least one sigmoid function and the portion of the measurement data stored in the memory and to control the transmission unit to transmit the determined position of the end of the traffic jam to at least one of the plurality of vehicles, the method comprising the acts of:

determining a plurality of parameter sets, wherein each parameter set defines a first sigmoid function and a second sigmoid function, the first sigmoid function modelling a speed profile and the second sigmoid function modelling a traffic density profile;

receiving the measurement data for the at least one vehicle of the plurality of vehicles;

rating a quality of at least some of the sigmoid functions defined by the parameter sets based on the received measurement data;

selecting at least one parameter set based on the rating;

computing the position of the end of the traffic jam using the at least one selected parameter set; and transmitting with the transmission unit the position of the end of the traffic jam to the plurality of vehicles.

11. The method as claimed in claim 10, further comprising the steps of:

generating further parameter sets using the at least one selected parameter set;

receiving further measurement data for two or more of the plurality of vehicles;

rating a quality of at least some of the sigmoid functions defined by the further parameter sets based on the further measurement data;

selecting at least one further parameter set based on the rating;

determining the position of the end of the traffic jam on the basis of the at least further selected parameter set;

transmitting with the transmission unit an updated position of the end of the traffic jam to the plurality of vehicles.

12. A non-transitory computer readable storage medium having executable instructions configured to perform the method as claimed in claim 10 when the instructions are executed by the computer unit.

* * * * *